US005094351A

United States Patent [19]

Barney

[11] Patent Number: 5,094,351

[45] Date of Patent: Mar. 10, 1992

[54] FISHING ROD HOLDER

[76] Inventor: Richard W. Barney, Rt. 1, Box 52, Wellsville, Kans. 66092

[21] Appl. No.: 735,430

[22] Filed: Jul. 25, 1991

[51] Int. Cl.[5] ..... A47F 7/00

[52] U.S. Cl. ..... 211/70.8; 211/117; 224/311; 224/922

[58] Field of Search ..... 211/70.8, 70.5, 113, 211/117; 224/922, 311, 42.46 A

[56] References Cited

U.S. PATENT DOCUMENTS

| | | | |
|---|---|---|---|
| 3,155,299 | 11/1964 | Home et al. | 224/311 |
| 3,524,572 | 8/1970 | Hall . | |
| 3,662,933 | 5/1972 | Michal | 224/922 X |
| 3,792,775 | 2/1974 | Riddle et al. | 211/70.8 |
| 4,003,612 | 1/1977 | Munsell | 211/70.8 X |
| 4,424,907 | 1/1984 | Robb | 211/70.8 |
| 4,779,914 | 10/1988 | Friedline | 211/70.8 X |
| 4,881,674 | 11/1989 | Medianik | 211/70.8 X |

*Primary Examiner*—Robert W. Gibson, Jr.
*Attorney, Agent, or Firm*—Fields, Lewis, Pittenger & Rost

[57] ABSTRACT

A versatile fishing rod holder for use with a variety of different vehicles has forward and rear rod holder members and four hanger brackets extending up from the corners with each hanger bracket having an outwardly extending flange preferably with a downturned lip to be received in a supporting socket on a top wall or window molding of a vehicle. The hanger bracket is adjustable in height and can be readily separated into two parts. The hanger is also width adjustable relative to the holder members.

14 Claims, 3 Drawing Sheets

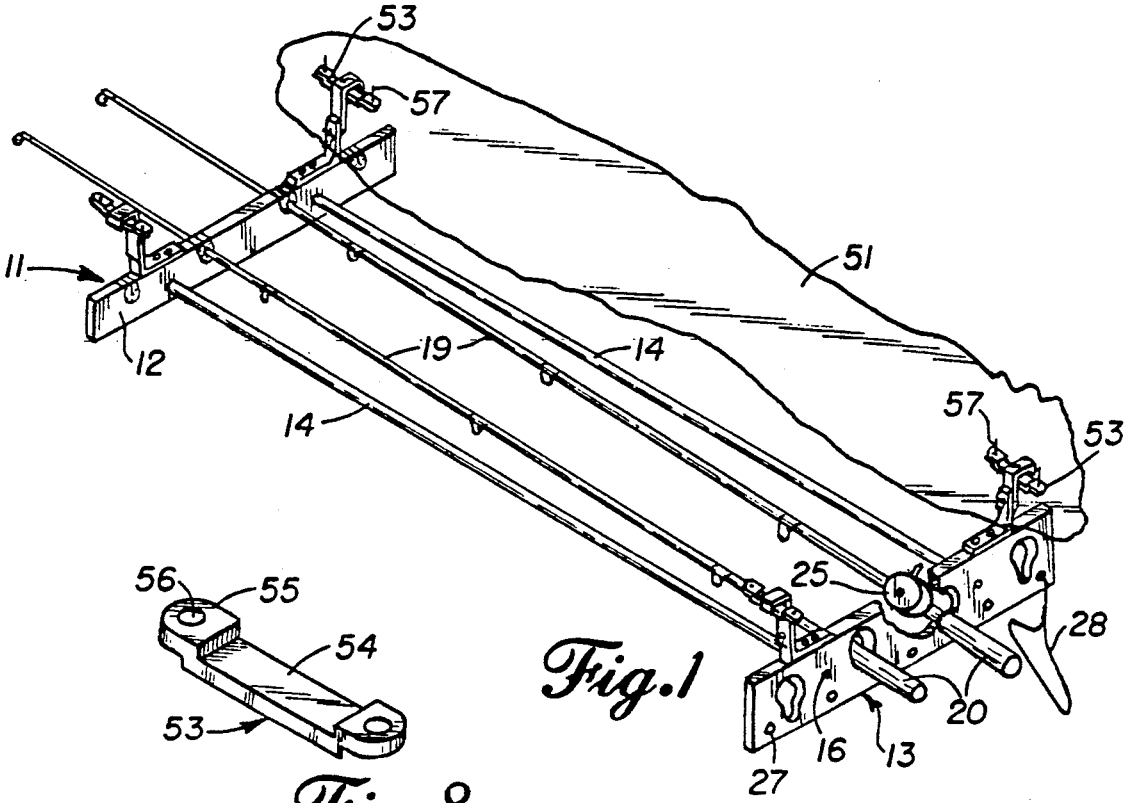
Fig.1
Fig.8
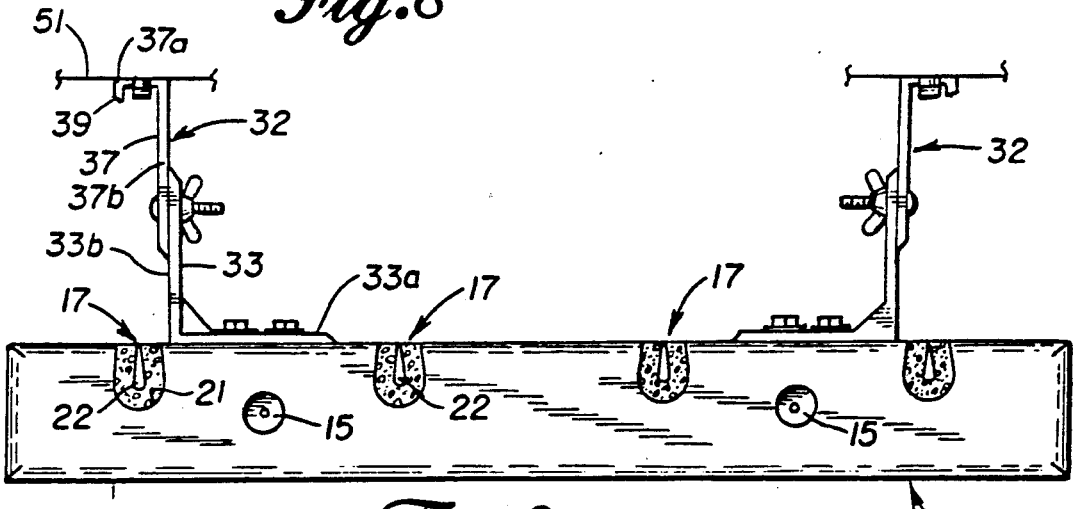
Fig.2
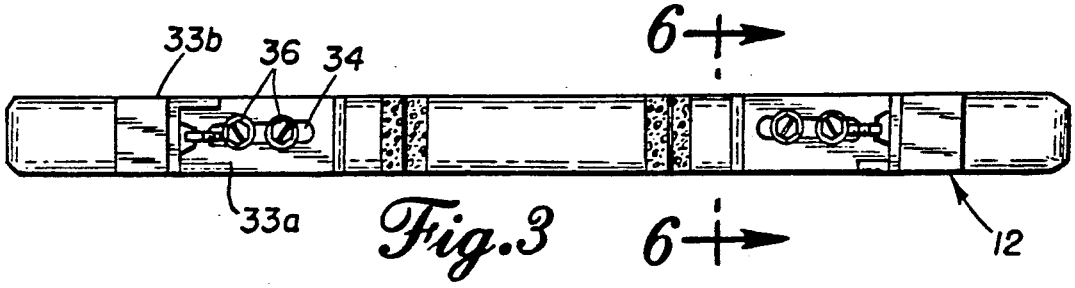
Fig.3

FISHING ROD HOLDER

TECHNICAL FIELD

This invention relates to a novel and improved holder or carrier for fishing rods during transport in a motor vehicle and storage when not in use.

BACKGROUND ART

Fishing rods with the reel when transported to a point of use may be damaged if they are dropped or stepped on when positioned on the floor of a motor vehicle or when stored. In U.S. Pat. No. 3,524,572 there is described a forward tubular holder member for supporting the forward end portion of a pole and a rearward holder member for gripping the pole forwardly of the reel with the holder members being arranged to releasably fasten to the roof of a vehicle or like top wall.

DISCLOSURE OF THE INVENTION

A fishing rod holder includes a forward holder member with a cushioned slot to receive and grip the forward portion of the rod and a reel holder member key hole-shaped with a hole to receive the handle of the rod with the holder members being secured a fixed distance apart. A pair of laterally spaced mounting hangers extends up from each holder member and is provided with a top outwardly extending leg or flange with a retaining lip to insert into a socket or a support to suspend the holder members with poles from the support. A narrowed lower portion of the rear holder member prevents the handles from movement. The mounting hangers are height and width adjustable for versatility of mounting in different vehicles.

BRIEF DESCRIPTION OF THE DRAWINGS

Details of this invention are described in connection with the accompanying drawings which like parts bear similar reference numerals in which:

FIG. 1 is a top perspective view of a fishing rod holder mounted to a top wall.

FIG. 2 is an elevational view of the forward holder member shown in FIG. 1 as viewed from the inside.

FIG. 3 is a top plan view of FIG. 2.

FIG. 8 is a perspective view of a female hanger member.

FIG. 11 is an enlarged view of an alternative mounting for the invention in the headliner of a Suburban-type vehicle or the like.

DETAILED DESCRIPTION

Figure 4:
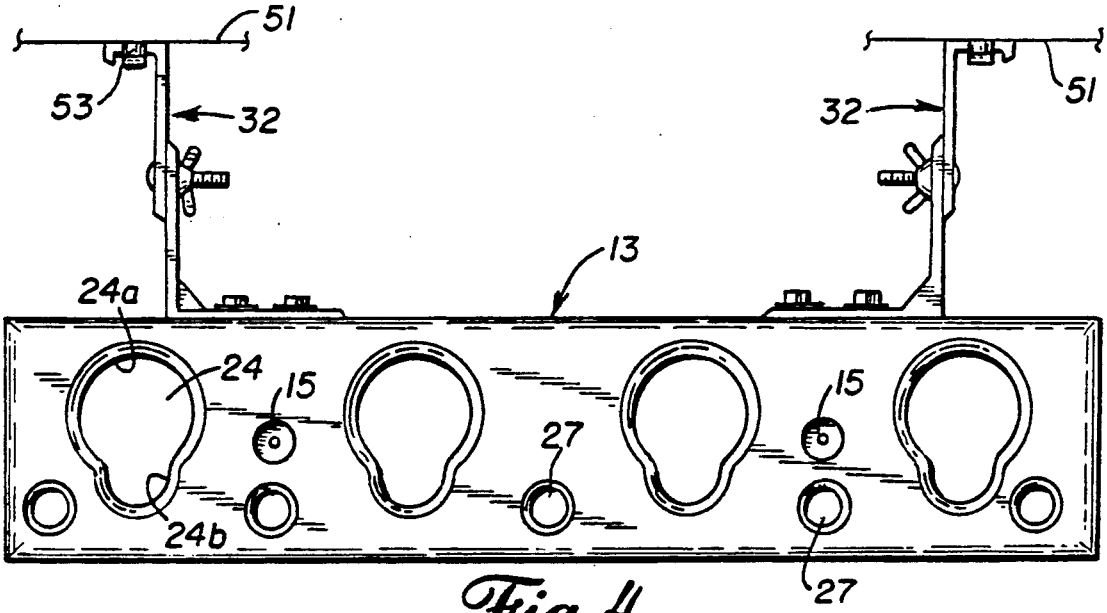
FIG. 4 is an elevational view of the rear holder member shown in FIG. 1.
Figure 5:
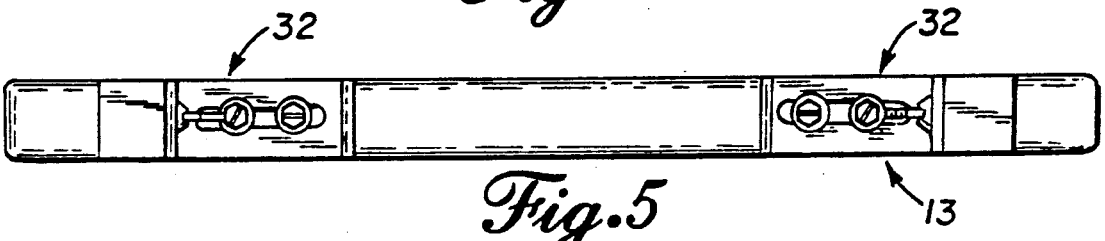
FIG. 5 is a top plan view of FIG. 4.
Figure 6:
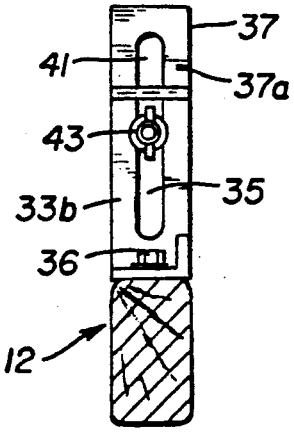
FIG. 6 is a sectional view taken along line 6—6 of FIG. 3.
Figure 7:
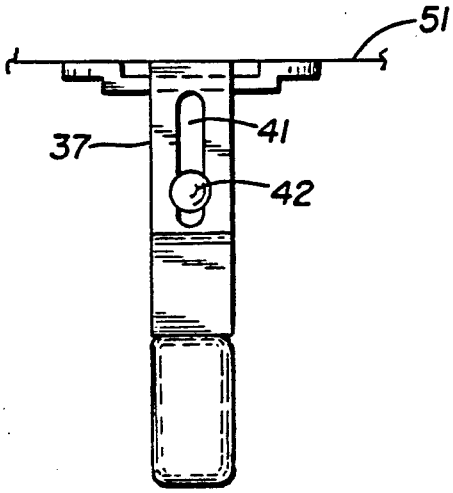
FIG. 7 is an end elevational view opposite line 6—6 of FIG. 3.

Referring now to the drawing there is shown a fishing rod holder assembly 11 which, in general, includes a laterally extending forward holder member 12 and a laterally extending rear holder member 13 secured a selected distance apart by a pair of rigid longitudinal connecting members 14 disposed a selected distance from the midpoint of the holder members which is the longitudinal center of the holder assembly. Each holder member has a hole 15 drilled partway into the inside wall into which an end of the connecting member inserts in a friction engagement. A wood screw 16 threads from the outside into the end of the connecting member. The connecting member preferably is a wooden dowel.

The forward holder member 12 shown is in the form of an elongated flat-sided, relatively narrow body that may be a wooden board, plastic or metal strip or the like. Wood with a varnish finish is preferable. The forward holder member has a plurality laterally spaced holder stations 17 formed by providing a top U-shaped notch 21 extending downwardly into the top edge and provided with a U-shaped cushion or resilient material such as a foamed weatherstrip to form a resilient or cushioned slit 22 narrower than the pole thickness into which the forward end portion of a fishing rod 19 is inserted and resiliently gripped to firmly hold the rod to the holder member. Four forward holder stations 17 are shown for supporting four rods but it is understood any number of stations may be provided according to the width of the vehicle.

The rear holder member 13 shown is also in the form of an elongated, flat-sided, relatively narrow body that may be a wooden board, plastic, metal or the like. Wood is preferable. The rear holder member 13 has a plurality of laterally spaced opening holes or apertures 24 sized to receive and support the rod handle 20. Each aperture 24 has a generally keyhole shape with a larger diameter upper portion **24*a* and a smaller diameter lower portion 24*b*. The reel 25 is forwardly of holder member 13. The smaller lower portion embraces and grips the typically cork rod handle to prevent movement during transport. A plurality of laterally spaced openings 27** are provided in the rear handle member to receive coat hangers so that coats, clothing, etc. may be hung from the holder assembly.

The mounting means for fastening the above described holder assembly 11 to a suitable support will now be described.

The mounting means shown is four identical hanger members 32 inset a distance from an end of the holder member 12 in a four corner configuration.

Each hanger member 32 has base bracket 33 of right angle shape with a bottom leg **33*a* with an elongated slot 34 and an upstanding leg 33*b* with an elongated slot 35. A pair of wood screw fasteners 36 extend down into slot 34 and the body of member 12 to secure the bracket thereto. An upper bracket 37 of right angle shape has a depending leg 37*a* and a top leg forming a flange 37*b* that extends laterally out and turns down to form an end lip 39. The depending leg has an elongated slot 41. A wing bolt 42 extends through the slots 35 and 41 and has a wing nut 43 threaded therein to secure the two members together and provide a height adjustment in the hanger member 32** to accommodate different types of vehicle mountings and different rod and reel sizes.

In some vehicle installations, the support will be a top wall of the vehicle indicated at 51. For this installation a female hanger bracket 53 shown in detail in FIG. 8 is used. These female hanger bracket members are located at front left, front right, rear left and rear right positions on a top supporting wall. Each female hanger bracket member includes a base section 54 and a pair of side sections 55 extending up from opposite side edges of the base section to define an inwardly facing socket or opening. The side sections have a hole 56 to receive a screw 57 or pop rivet.

Figure 9:
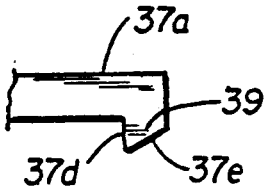
FIG. 9 is an enlarged view of the end of a hanger member.
Figure 10:
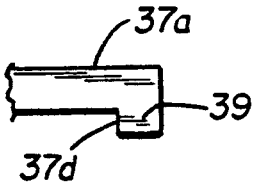
FIG. 10 is an enlarged view of a modified form of flange for the hanger member.
Figure 11:
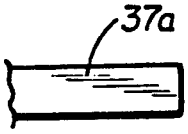
Figure 12:
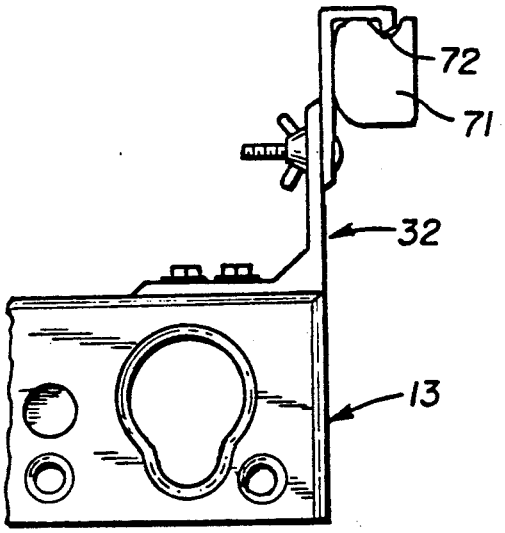

Referring now to FIGS. 9–11 there is shown an enlarged end portion of the outward leg portion 37*a* with the downturned lip 39 forming a retaining edge 37*d*. The downturned edge is beveled or inclined to gradually narrow toward the outer terminal end to slide fit into the bracket opening above described and the retaining edge prevents the hanger from coming loose. An alternative shown in FIG. 10 is to have a non-beveled edge forming the retaining edge 37*d*. For some applications another form of retainer may be provided to releasably lock the leg 37*a* to the support in which case the retaining edge could be eliminated as shown in FIG. 11.

For vehicles such as a Suburban having a headliner molding indented at 71 above the window the outwardly projecting flange 27*a* with retaining lip 27*d* slips into a socket portion formed by the headliner molding and is retained by the lip. In this form the bracket assembly 32 is mounted at the end of front and rear holder members.

To install the holder assembly 11 in the form shown in FIGS. 1–8, the hanger brackets 53 are attached to the top wall using screws, rivets or the like. These are a fixed distance apart and a fixed distance from front to rear. The screw fasteners are louvered so that the leg or flange 37*a* will slide into the associated bracket and the screws 36 are tightened. The height is adjusted by loosening the wing nuts and re-tightening. To put the rod into the holder assembly the forward end is placed over the front holder member and the handle is inserted into the rear holder aperture and placed against the smaller slot portion. The forward end portion is moved down against the cushioned slit for quick removal, the wing nuts may be removed and the holder assembly with poles stored inside a building by having two nails support the forward holder members and the assembly in a depending manner.

Although the present invention has been described with a certain degree of particularity, it is understood that the present disclosure has been made by way of example and that changes in details of structure may be made without departing from the spirit thereof.

What is claimed is:

1. A fishing rod holder comprising:

a holder assembly including a forward holder member having at least one holder station for a forward end portion of a fishing rod, a rear holder member having at least one rear holder station for holding a handle portion of a fishing rod, longitudinal connecting means securing said forward and rear holder members a selected distance apart, and mounting means for fastening said holder assembly to a support to hang said holder assembly from said support, said mounting means including left side and right side forward hanger means extending up from said forward holder member, and left side and right side rear hanger means extending up from said rear holder member, each said hanger means including an upstanding member and an outturned flange to be received in a socket of said support to be retained in said socket, whereby said holder assembly and fishing rod are suspended from said support.

2. A fishing rod holder as set forth in claim 1 wherein said forward holder station is in the form of a U-shaped top notch with a resilient material lining the notch to form a cushioned slit.

3. A fishing rod holder as set forth in claim 1 wherein said rear holder station is an opening of key hole shape with a larger upper diameter and a smaller lower diameter, the lower diameter being sized to grip the pole handle.

4. A fishing rod holder as set forth in claim 1 wherein said rod has a reel disposed forwardly of said rear holder.

5. A fishing rod holder as set forth in claim 1 wherein said hanger means includes a base bracket of right angle shape with a bottom leg having a slot slidably mounted to the associated member by screws to provide lateral adjustment, and an upstanding leg with a slot, an upper bracket of right angle shape with a depending leg with a slot and an outturned leg providing a fastening flange, said depending leg having a slot with a nut and bolt fastener extending through said slots to provide vertical adjustment of said flange.

6. A fishing rod holder as set forth in claim 1 wherein said flange extends down at the end to form a retaining lip with a retaining edge.

7. A fishing rod holder as set forth in claim 1 wherein said retaining lip has a beveled edge and gradually narrows toward an outer terminal end.

8. A fishing rod holder as set forth in claim 1 wherein said retaining lip is of uniform width toward the outer terminal edge.

9. A fishing rod holder as set forth in claim 1 wherein said flange is of uniform width toward the outer terminal edge.

10. A fishing rod holder as set forth in claim 1 wherein said forward and rear holder members have oppositely disposed outer ends, said left and right side forward hanger means extend up from said outer ends of said forward holder member and said left and right side rear hanger means extend up from said outer ends of said rear holder member, and each said flange is supported and retained by a headliner molding of a vehicle.

11. A fishing rod holder as set forth in claim 1 wherein said hanger means is inset a selected distance from an end of said holder members to form a four corner hanging configuration.

12. A fishing rod holder as set forth in claim 1 including a female hanger bracket of U-shaped cross-section secured to a top wall forming an inwardly facing socket opening for slidably receiving each associated flange.

13. A fishing rod holder as set forth in claim 1 wherein said rear holder member has apertures for receiving a coat hanger to support said coat hanger.

14. A fishing rod holder comprising:

a holder assembly including a forward holder member having a series of laterally spaced U-shaped top recesses into which a forward end portion of a fishing rod is received and releasably held, a rear holder member having a series of laterally spaced apertures into which the handle portion of a fishing rod is received and releasably held, left and right longitudinal connecting members securing said forward and rear holder members a selected distance apart, and four hanger brackets secured to the underside of a support wall, each said hanger bracket having a female socket portion, mounting means for fastening said holder assembly to a support to hang said holder assembly from said support, said mounting means including left side and right side forward hangers extending up from said forward holder member, and left side and right side rear hangers extending up from said rear holder member, each said hanger member including an upstanding leg member and an outturned flange slidably received in an associated socket portion of said hanger brackets to be retained in said socket portions, whereby said holder assembly and fishing rod are suspended from said brackets and support wall.

* * * * *